United States Patent [19]

Berge

[11] Patent Number: 4,603,648

[45] Date of Patent: Aug. 5, 1986

[54] WATERCRAFT WITH AT LEAST TWO TWIN HULLS

[76] Inventor: Jacques Berge, Château d'Areyt, 65400 Préchac, France

[21] Appl. No.: 608,232

[22] Filed: May 8, 1984

[30] Foreign Application Priority Data

May 9, 1983 [FR] France ..... 83 07747

[51] Int. Cl.[4] ..... B63H 9/04

[52] U.S. Cl. ..... 114/39; 114/90; 114/102; 114/61; 114/144 R

[58] Field of Search ..... 114/39, 90, 102, 61, 114/144 R, 163, 354; 440/62; 244/230, 231, 232, 90 B; 403/217-219, 169-172; 74/471 R, 501 R

[56] References Cited

U.S. PATENT DOCUMENTS

| | | | |
|---|---|---|---|
| 1,408,868 | 3/1922 | Dutcher | 114/90 |
| 2,893,339 | 7/1959 | Ram | 114/39.1 |
| 2,944,505 | 7/1960 | Berge | 114/39.1 |
| 3,045,263 | 7/1962 | Blachly | 114/61 |
| 3,142,282 | 7/1964 | Nichols | 114/39.1 |
| 3,195,494 | 7/1965 | Robin | 114/39.1 |
| 3,438,349 | 4/1969 | Curtis et al. | 114/102 |
| 3,802,371 | 4/1974 | Jastrab | 114/102 |
| 4,230,060 | 10/1980 | McCoy | 114/39.1 |
| 4,444,145 | 4/1984 | Kohl | 114/163 |

FOREIGN PATENT DOCUMENTS

| | | | |
|---|---|---|---|
| 440240 | 7/1912 | France | 244/230 |
| 2480702 | 10/1981 | France | 114/102 |
| 144655 | 3/1954 | Sweden | 114/39.1 |

*Primary Examiner*—Trygve M. Blix
*Assistant Examiner*—Edwin L. Swinehart
*Attorney, Agent, or Firm*—Steinberg & Raskin

[57] ABSTRACT

The invention relates to a catamaran-type sail boat comprising several inclined mast-like elements rotatively mounted at their lower ends and upper ends respectively by appropriate lower connecting mechanism and upper connecting mechanism, the masts being provided over at least a portion of their length with a fin rigidly connected to the masts, the fin working as a sail. Angular rotation positioning mechanism is provided to rotate the rotatable masts provided with the fin so that the boat can be driven at will.

21 Claims, 17 Drawing Figures

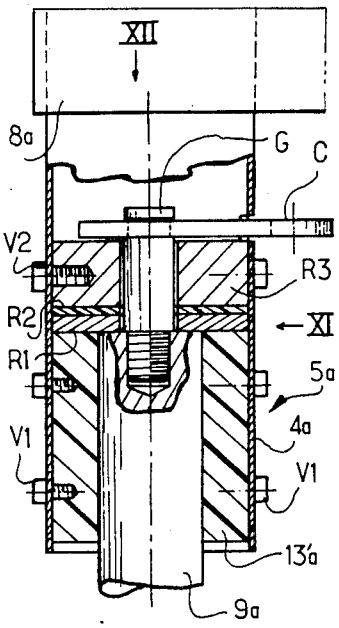
Fig. 10
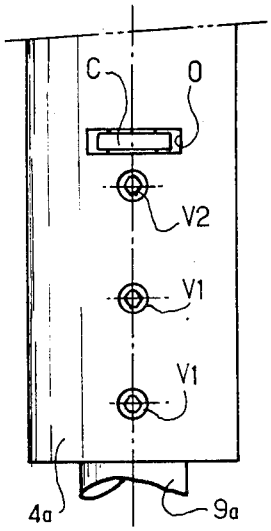
Fig. 11
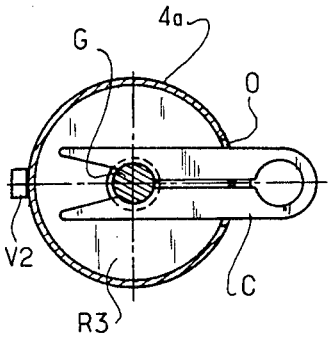
Fig. 12
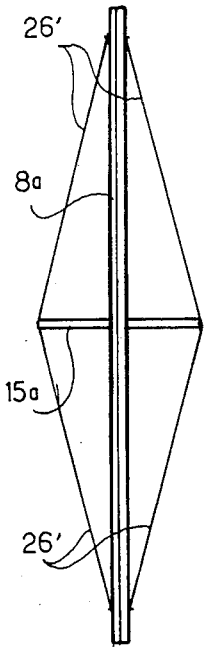
Fig. 14a
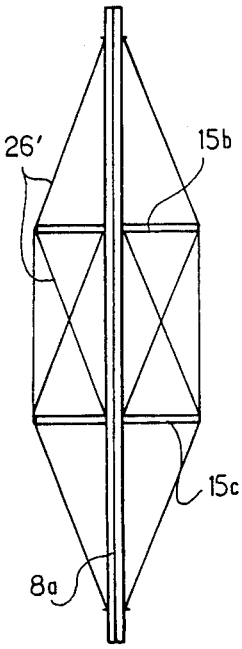
Fig. 14b
Fig. 13
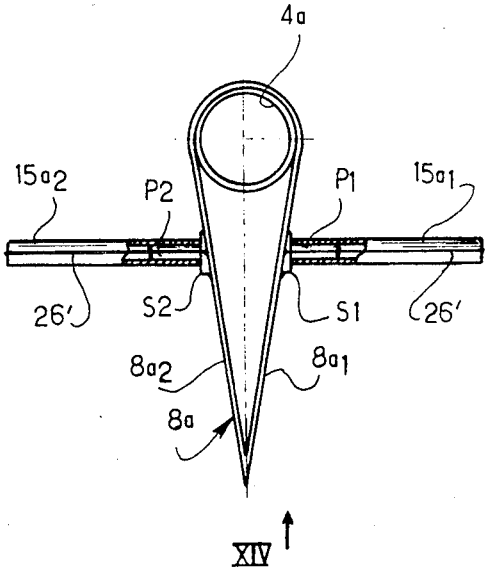

WATERCRAFT WITH AT LEAST TWO TWIN HULLS

The present invention has for a subject matter a watercraft or boat with at least two twin hulls, such as a catamaran.

The invention is an improvement in the watercraft with several hulls, described in Applicant's French patent No. 1 127 903, which watercraft is provided with several masts or the like fixed at their lower end to one of the said hulls and assembled together at their upper end at one or several common points.

According to the invention, at least some of the said masts are provided over at least a portion of their length with a fin rigidly connected to the said mast, which mast is mounted rotatably at its lower and upper ends.

According to another feature of the invention, the watercraft comprises two hulls connected to one another by a set of four masts assembled together at their upper ends at a common point, particularly by a pyramidal structure, and fixed at their lower ends towards the front and towards the rear of the said hulls.

According to another feature of the invention, there are provided substantially horizontal reinforcing cross-members interconnecting in pairs the said front and rear masts, the device for fixing each cross-member to a mast comprising a collar means fixed to the said cross-member and in which the said mast can rotate.

According to still another feature of the invention, a slot, particularly of square, triangular or trapezoidal shape, is provided in the said fin in the region of the said collar.

According to still another feature of the invention, means for fixing the shrouds are provided through the said cross-members.

According to another feature of the invention, the aforesaid pyramidal structure includes two front and rear triangles constituted by tubes pivotally accommodated in the upper ends of the said masts and rigidly connected to one another.

According to another feature of the invention, the said rigidly connecting means include a linking plate provided between the tubes constituting one of the said triangles forcedly bearing against a plate intercalated between the plates connecting the tubes of the other triangle.

According to still another feature of the invention, the linking elements between the said hulls are constituted by telescopic tubes.

According to still another feature of the invention, there are provided means for adjusting the angular position of each of the aforesaid fins, each said adjusting means including particularly a first pulley rigidly connected to the lower end of the mast and pivoting about the longitudinal axis of the mast, on which pulley the control cable is wound a complete turn and to which it is fixed; and a system of guide pulleys for directing both portions of the said cable in a direction substantially parallel to the longitudinal axis of the watercraft towards a drum rotatable about an axis substantially perpendicular to the longitudinal axis of the watercraft and actuated by a flywheel.

According to another feature of the invention, the watercraft includes at least one pivoting triangular sail suspended from the point of connection of the said masts, the point of application of the axis of the boom being located substantially at one fifth of its length from the front of the latter.

According to another feature of the invention, there is provided a device for tensioning the stay on which the leading edge of the said sail slides; this tensioning device is constituted either by a tackle pulling on the said stay or by a tackle controlling a cable pulling upwardly on a semi-circular rolling path.

According to still another feature of the invention, each hull of the watercraft being equipped with a rudder controlled by a same bar, there is provided a device for adjusting the relative angular position of one rudder with respect to the other. To this end, each said rudder is connected to the said bar by a system of pulleys and a cable, one end of the said cable being fixed to the said bar and the other end being fixed to a slide provided with a roller displaceable in an oblong opening provided in a frame rigidly connected to the said bar and whose longitudinal axis is substantially parallel to the longitudinal axis of the said bar, an adjustable stop allowing the displacement of a roller, in one direction, in the said opening to be limited in a predetermined manner.

The invention will be better understood and other details, features and advantages thereof will appear more clearly as the following explanatory description proceeds with reference to the appended diagrammatic drawings given solely by way of example illustrating one preferred form of embodiment of the invention and wherein.

Figure 8:
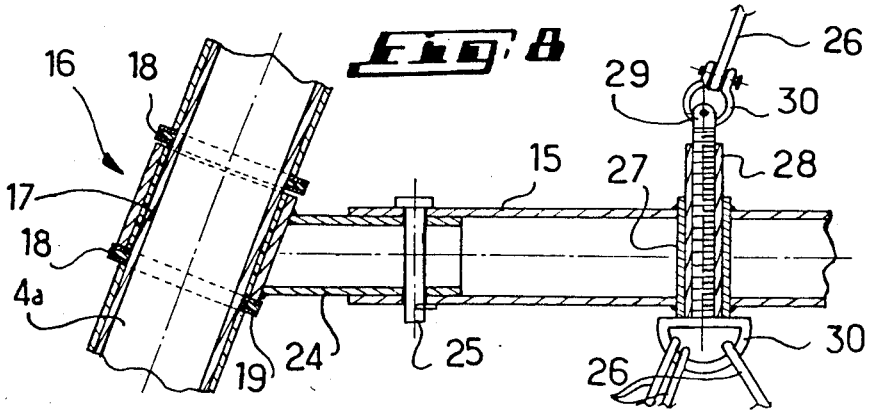
Figure 7:
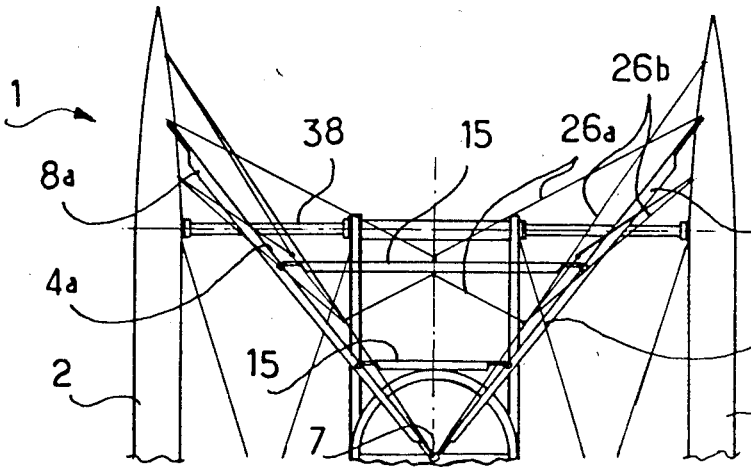
Figure 9:
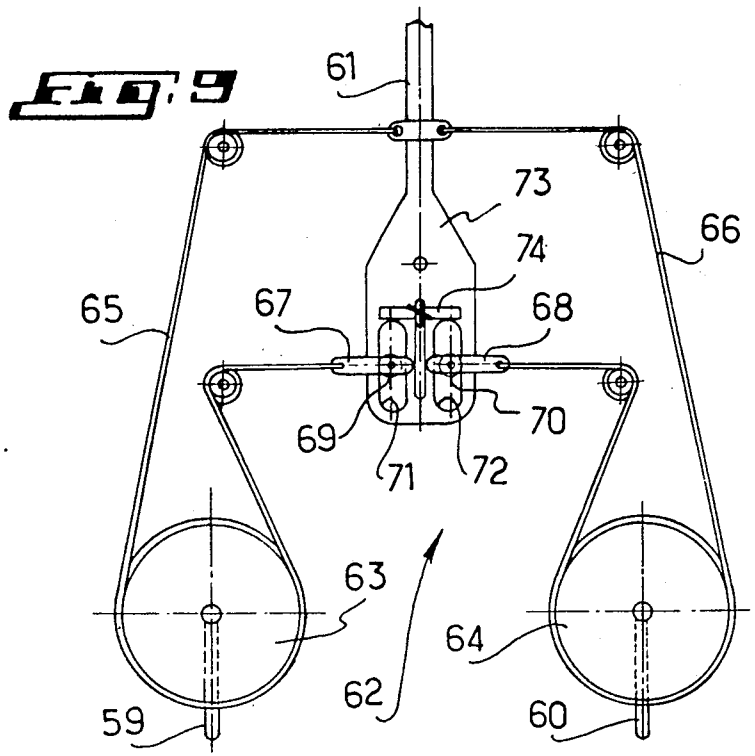
Figure 6B:
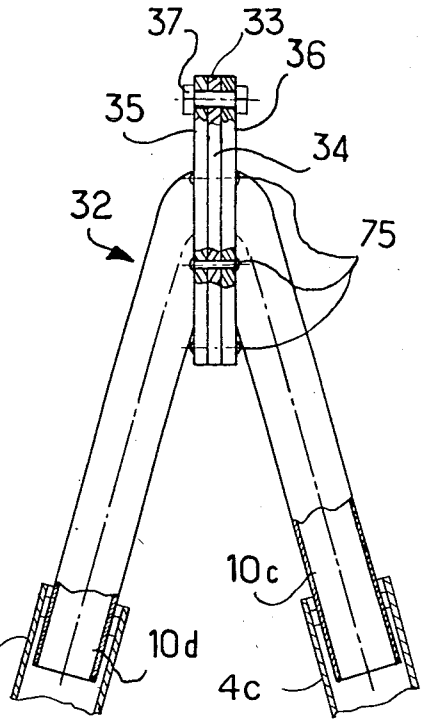
Figure 6A:
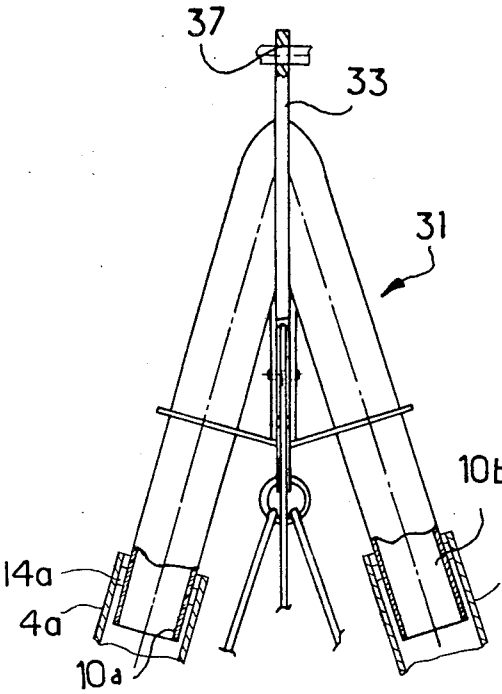
Figure 6C:
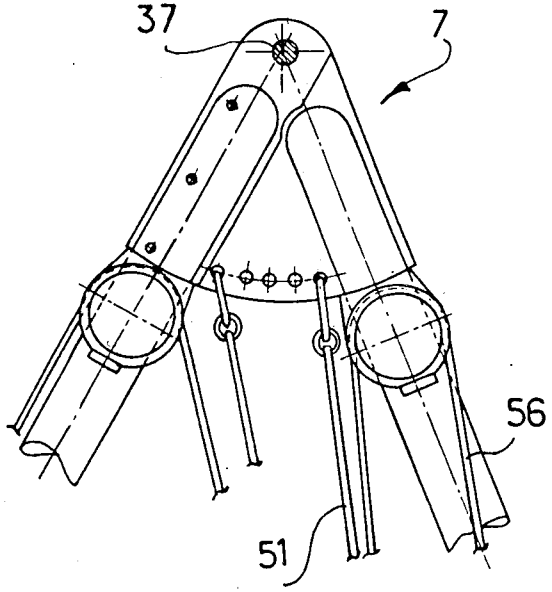

FIG. 6*a* is a partial sectional view of the front mast-linking triangle;

FIG. 6*b* is a partial sectional view of the rear mast-linking triangle;

FIG. 6*c* is a view illustrating the front and rear triangles in the mounted position;

FIG. 7 is a partial top view of the watercraft of the invention;

FIG. 8 is a sectional view of another form of embodiment of the mast-cross-member link with the fixing means for the shrouds;

FIG. 9 is a diagrammatic view of a watercraft steering device according to the invention;

FIG. 10 is another longitudinal sectional view of a mast according to the invention;

FIG. 11 is a view in the direction of arrow XI of FIG. 10;

FIG. 12 is a top view in the direction of arrow XII of FIG. 10;

FIG 13 is a cross-sectional view of the mast according to another form of embodiment; and FIGS. 14*a* and 14*b* are views in the direction of arrow XIV of FIG. 13, illustrating two forms of embodiment of shroudings associated with the mast of the invention.

The watercraft or boat 1 with at least two twin hulls 2,3, such as a catamaran, is provided with several masts or the like 4*a*,4*b*,4*c*,4*d* fixed at their lower end 5a,5b,5c,5d to one of the said hulls and assembled together at their upper end 6a,6b,6c,6d at one or several common points 7.

According to the invention, at least some of the said masts are provided over at least a portion of their length with a fin 8a,8b,8c,8d rigidly connected with the said mast, the said mast being mounted rotatably at its lower end 5a–5d and at its upper end 6a–6d. The plane of the fin is parallel to the longitudinal axis of the mast.

In the example illustrated, the watercraft 1 includes two hulls 2,3 connected together by a set of four masts 4a–4d assembled to one another at their upper ends 6a–6d at a common point 7, particularly by a pyramidal structure, and fixed at their lower ends 5a–5d towards the front and towards the rear of the said hulls.

Thus, the four masts are so arranged as to be pivotable at their lower and upper ends.

The pivoting is controlled either by means of levers of various kinds, or by the winding of a cable as will be described in more detail hereafter. This device allows the steersman to adjust at each instant the horizontal axial angle of each mast in the form of a wing with respect to the direction of the wind and to lock it in that position, or to allow the mast to freely pivot and thus take a leeward position in the same manner as a weathervane. Each mast thus constitutes a small sail.

Owing to this arrangement, by placing in opposition the front masts and the rear masts, the catamaran is compelled to pivot irrespective of the force of the wind. It is thus possible to veer upwind even in heavy weather.

By adjusting the angle of attack of the wind on the front masts and the rear masts, it is possible to obtain a state of equilibrium on the desired course without holding the bar.

By veering the masts by 180° in the forward direction, it will be possible to navigate by moving backward and thus handle the watercraft, either to leave a quay where the watercraft is moored by its fore, or to move forward and backward in a reduced space while at the same time steering the watercraft. The ingress into or the egress from a port or a berth are thus considerably facilitated, since the constant control of the angle of each mast allows accelerating, slackening the speed or sailing at low speed, all of which things were impossible up to the present on the known boats or catamarans. Moreover, in heavy weather, the possibility of orientating the masts along the axis of the wind provides an important safety.

Figure 4:
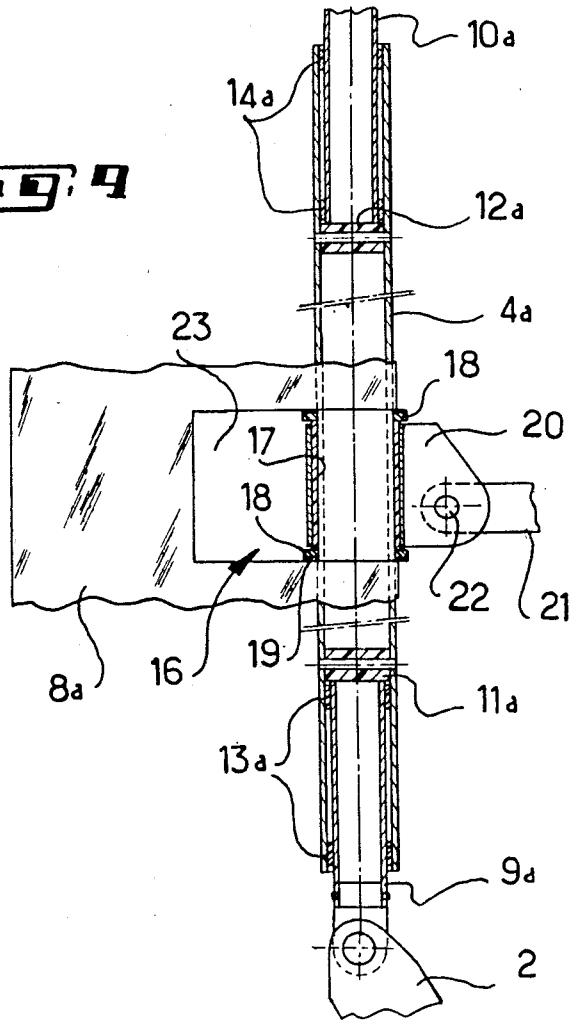
FIG. 4 is a longitudinal sectional view of a mast according to the invention.

Referring particularly to FIG. 4, the lower end 5a and the upper end 6a of each mast (for example 4a) are rotatably mounted on two portions 9a, 10a, fixed, on the one hand, to a hull (for example 2) and forming part, on the other hand, of the mast-connecting pyramidal structure 7. Such mounting is performed through the medium of supports 11a, 12a and of sleeves 13a,14a of anti-friction material, such as for example "Teflon".

Figure 5:
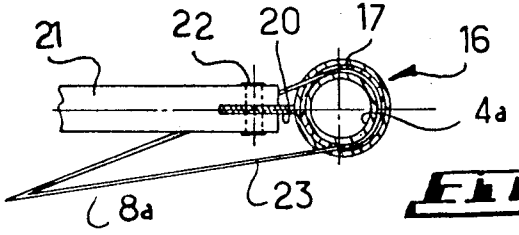
FIG. 5 is a cross-sectional view of the mast-cross-member connection.

In order to interconnect the front and rear masts in pairs, there are provided substantially horizontal reinforcing cross-members 15. Referring to FIGS. 4 and 5, the device for fixing each cross-member 15 to a mast 4a includes a collar means 16 secured to the cross-member 15 and in which the mast 4a can rotate. The collar 16 includes a sleeve 17 and rings 18 of an anti-friction material, such as for example "Teflon", arranged between metal rings 19. A plate 20 is fixed to the collar 16 and is fitted into the solid end 21 of the cross member 15, where it is secured, for example, by means of a removable rivet 22 or the like.

There is also provided a slot 23, e.g. of square or rectangular shape, in the fin 8a in the region of the collar 16, so as to increase the possible angle of rotation of the mast and of the fin up to about 330°. It is trapezoidal in the case of FIG. 8.

Figure 2:
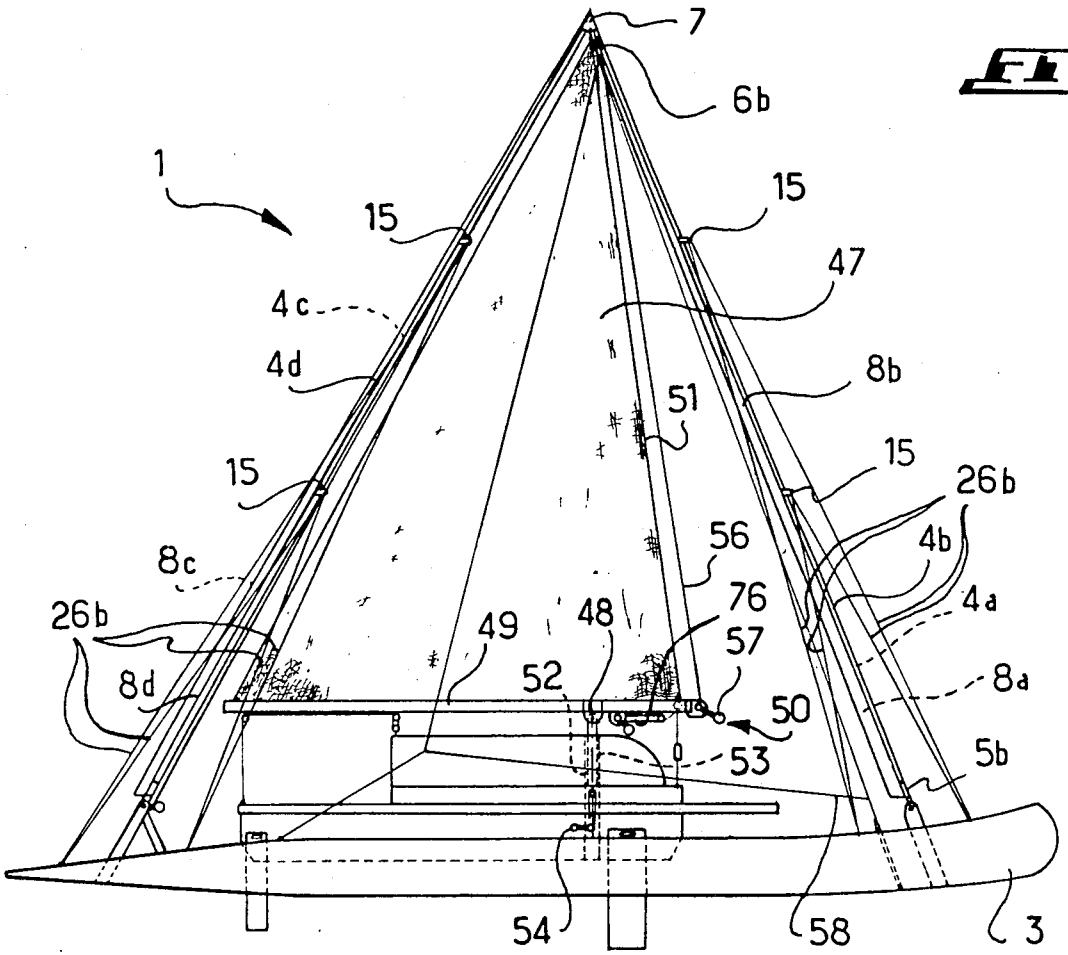
FIG. 2 is a side view of the watercraft according to the invention.
Figure 3:
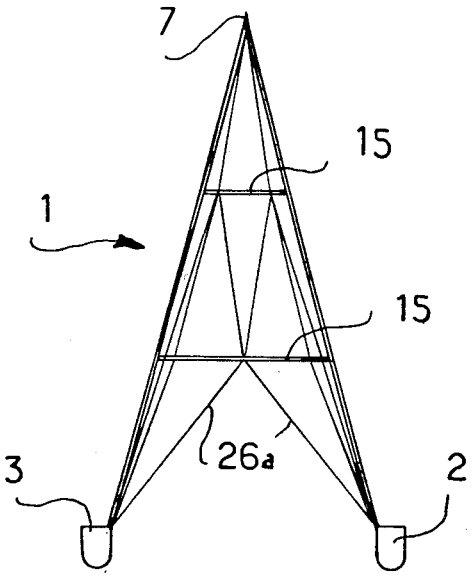
FIG. 3 is a diagrammatic front view of the watercraft of the invention.

Referring to FIGS. 7 and 8, means for fixing the shrouds 26 are provided in the cross-members 15, so that the latter do not interfere with the rotation of the masts. It will be noted that the only stress to which the shrouds are subjected in this case consists in preventing the masts from moving away from the points of rotation. Referring more particularly to FIG. 7, the collar 16 is rigidly connected to a tube portion 24 fitted into the end of the cross-member 15 and secured therein by a rivet 25 or the like. Between the shackles 30 through which the shrouds 26 pass, there is provided a threaded rod 29 extending through a threaded tube 28 sliding in a tube 27 welded to the cross-member 15 and passing therethrough from side to side. In FIGS. 2, 3 and 7 are shown the lateral shrouding 26a and the longitudinal shrouding 26b.

Referring more particularly to FIGS. 6a to 6c, the pyramidal structure 7 includes a front triangle 31 and a rear triangle 32 constituted by tubes 10a–10d pivotally inserted into the upper ends 6a–6d of the masts 4a–4d and rigidly connected to one another. These rigidly connecting means include a linking plate 33 provided between the tubes constituting one of the said triangles, preferably the front triangle, forcedly bearing against a plate 34 intercalated between the plates 35,36 connecting the tubes of the other triangle. The plates 34,35,36 are secured by any appropriate means 75. The connection between the triangles 31 and 32 is moreover ensured by a common pin 37. A certain number of ropes can be hung on the pyramidal structure 7, possibly through the medium of pulleys, such as the halliard 56 or the stay 51 of the sail.

According to another form of embodiment, the four masts in the form of fins may be designed in a single piece, without slots. In this case, the masts are made rigid in the direction of their thickness, as seen in FIG. 14a or 14b, by means of shrouds 26' associated with the cross-member 15a (FIG. 14a) or two cross-members 15b and 15c (FIG. 14b). Each of these cross-members is mounted in substantially perpendicular relationship to each pin (8a in the present case) in the manner shown in FIG. 13. As appears from this Figure, each cross-member is constituted by two cross-member elements ($15a_1$ and $15a_2$ in the present case) mounted in alignment on the opposite external faces $8a_1$ and $8a_2$, respectively, of the fin. Each cross-member element presents in the region of its end a portion in the form of a tube into which is fitted a centering foot (P1; P2) rigidly connected to a support plate (S1; S2) secured to the external face ($8a_1$; $8a_2$), e.g. by welding. It is thus understood that the cross-members 15a, 15b, 15c are removable from the centering feet to facilitate the transport.

The shrouding of FIG. 14a has a lozenge-shaped configuration. In this case, the shrouds 26' are fixed in proximity to the longitudinal ends of the fins and to the free ends of the cross-members by any appropriate means such as hook-shaped portions welded directly to the fin, on the one hand, and rigidly connected to the free ends of the cross-members, on the oher hand.

The shrouding of FIG. 14b, owing to the presence of the two cross-members 15b, 15c mounted in spaced arrangement along the fin and particularly of shrouds 26' diagonally connecting each cross-member element, allows ensuring an improvement rigidity of the fin in the direction of its thickness.

FIGS. 10 to 12 illustrate another form of embodiment of the pivotal connection of the masts at their lower and upper ends 5*a* and 6*a*. There will be described only the pivotal connection at the lower end, i.e. at the hull 2. The lower end 5*a* of each mast is rotatably mounted on a fixing tube portion or pin 9*a* fixed to the hull as in the case of FIG. 4 through the medium particularly of a cylindrical sleeve 13'*a* of an antifriction material such as for example "teflon". The sleeve 13'*a* is rigidly connected to the tube of the mast 4*a* through the medium of fastening screws $V_1$. On the coplanar free ends of the tube 9*a* and of the sleeve 13'*a* within the mast 4*a* are placed rings R1, R2, R3 in stacked arrangement from bottom to top (in the case of FIG. 10), respectively. The rings R1 and R3 are of any metal whereas the ring R2 is of an anti-friction material such as for example "Teflon". The ring R3 is rigidly connected to the mast 4*a* through the medium of fastening screws $V_2$. A stud G is mounted in coaxial alignment with the tube 9*a* and extends throughout the stack of rings R1 to R3. This stud is provided at its endmost portion with an annular groove around which are inserted the two legs of a spring cotter C. The latter is inserted through an opening in the form of a slit O substantially opposite the groove of the stud G. The cotter C in the mounted position projects from the opening O for it to be accessible. Such a pivotal connecting structure allows the compressive forces and the pulling forces to be withstood, the latter being very brief and unimportant.

Furthermore, each fin may be arranged to receive a jib (not shown) along the generatrix of the tube of the fin-mast opposite the edge formed by the acute angle of the fin seen for example in FIG. 13.

Figure 1:
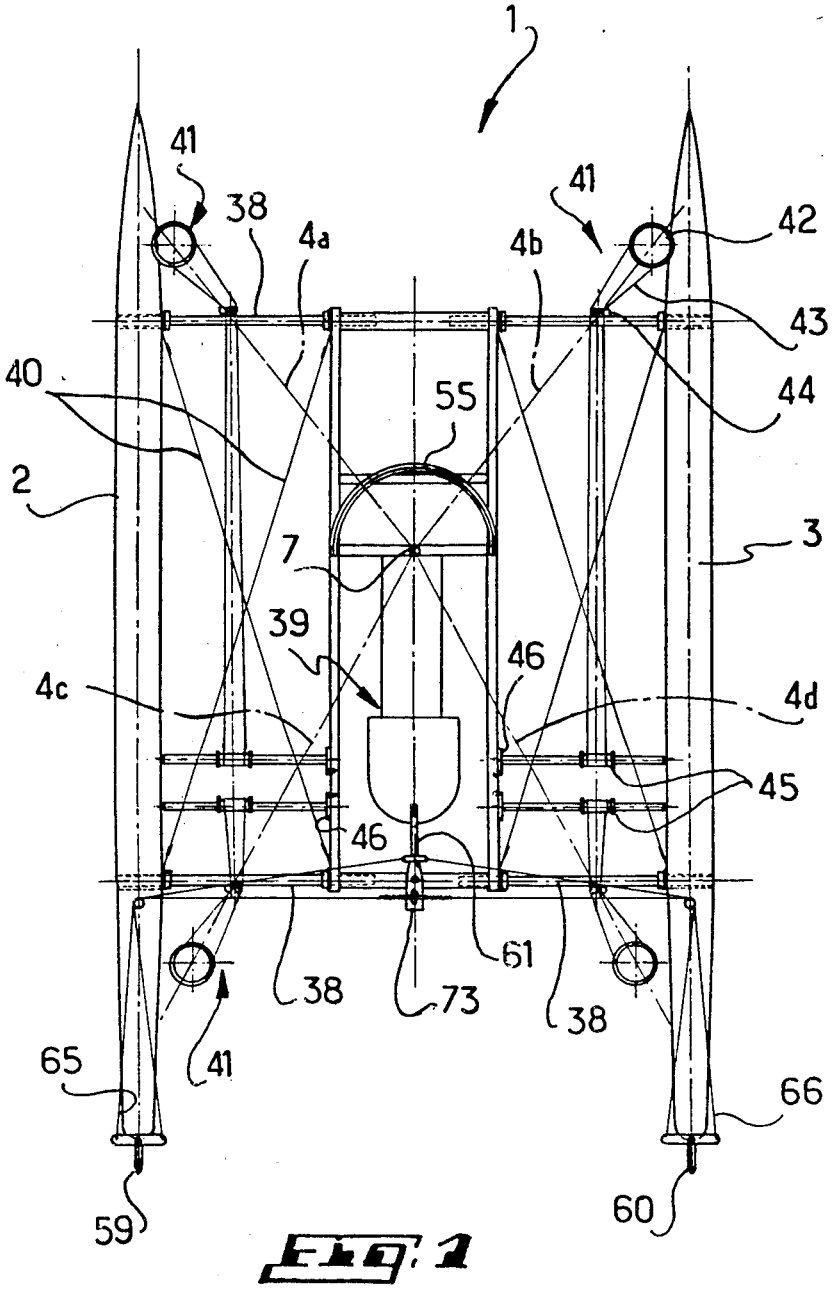
FIG. 1 is a top view of the watercraft according to the invention, on which the masts have been diagrammatized in chain-dotted lines.

Referring more particularly to FIG. 1, the connecting elements between the hulls 2,3 are constituted by telescopic tubes 38. These connecting means may be reinforced by shrouds 40, the binnacle 39 being provided in the central portion of the watercraft. This telescopic structure allows in particular reducing, for example from 8 meters to 2.40 meters, the width after disassembly, thus making possible the road transport of the watercraft as well as its accommodation in a yard or a garden.

There are described hereafter in detail the means 41 for adjusting the angular position of each of the aforesaid fins or masts.

Referring to FIG. 1, each adjusting means 41 includes a first pulley 42 (possibly a pulley with two grooves) rigidly connected to the lower end of a mast and pivoting around the longitudinal axis of the mast, on which pulley the control cable or cables 43 are wound in a complete turn and to which it or they are fixed, and a system of guide pulleys 44 (constitited for example by two pulleys inclined at an appropriate angle) to direct the two portions of the cable 43 in a direction substantially parallel to the longitudinal axis of the water-craft towards a drum 45 rotatable about an axis substantially perpendicular to the longitudinal axis of the watercraft and actuated by a flywheel 46. In the case of a double pulley, there is on each pulley a cable wound half a turn, the fin being in perpendicular position, with respect to the axis of the hulls, for adjusting the cables. As shown in FIG. 1, the four control flywheels are readily accessible by the steersman.

Referring now more particularly to FIG. 2, the watercraft 1 comprises at least one pivoting triangular sail 47 suspended from the connection point 7 of the mast 4*a*–4*d*, the said sail being inscribed in the pyramid defined by the four masts. The points of connection of the supporting pin 48 of the boom 49 is located substantially at a fifth of its length from the front end thereof. In this case, under the action of the wind, the whole of the sail self-balances so that the angle with the axis of the wind is substantially identical from bottom to top. This peculiarity allows obtaining a remarkably small come-round angle.

There is also provided a device 50 for tensioning the stay 51 on which the leading edge of the sail 47 slides.

The device 50 may be constituted by a tackle pulling on the said stay or by a tackle controlling a cable pulling upwardly on a semi-circular rolling path 55.

The axis pin 48 of the boom 49 being constituted particularly by two telescopic tubes (e.g. a stationary tube 52 and a movable tube 53) the relative position of which is adjusted by a tackle 54 or the like, the tackle 54 fixed within and at the bottom of the stationary tube 52 pulls on the lower portion of the sliding tube 53 on which is fixed the boom 49. This allows obtaining an adjustable curvature of the said boom and thus adjusting the hollow of the sail.

In the second case, there exist two possibilities: either the cable connecting the head of the boom to the rolling path is stationary (with, however, a stiffener) and the tackle 76 pulls on the stay through an idler, or the stay is fixed and the tackle 76 pulls on the rolling path through an idler.

The halliard 56 of the sail is actuated by a winch 57, and a jib 58 may also be provided.

Referring now more particularly to FIG. 9, each hull being equipped with a rudder 59,60 controlled by the same bar 61, there is provided a device 62 for adjusting the relative angular position of one rudder with respect to the other.

Indeed, it is known that it is interesting for a catamaran, during a turn, that the angle made by the rudder located inside the curve be more accentuated than the angle of the external rudder.

To this end, each rudder 59,60 is connected to the bar 61 by a system of pulleys and a cable 65,66 (one pulley 63,64 of which is solid in rotation with the rudder 59,60). One end of the cable 65,66 is fixed to the bar 61 and the other end is fixed o a slide 67,68 provided with a roller 69,70 made from an anti-friction material such as for example "Teflon", displaceable in an oblong opening 71,72 provided in a frame 73 rigidly connected to the bar 61, the longitudinal axis of the said opening being substantially parallel to the longitudinal axis of the bar. An adjustable stop 74 allows limiting in a predetermined manner the displacement of a roller, in one direction, in the said opening. The bar being for example starboarded, the pulling of the cable moves the starboard roller towards the adjustable stop. The angle taken by the starboard rudder can thus be reduced at will. On the other hand, the roller which controls the port rudder is moved in the end of the port opening to allow the desired angle to take place.

What is claimed is:

1. A catamaran-type sail boat comprising at least two separate hulls, connecting means between said hulls comprising several inclined mast-like elements, each having an upper end and a lower end, lower connecting means between the lower end of each inclined mast-like element and the respective hull, upper connecting means for connecting together the upper ends of at least some of said masts providing thereby a rigid-type connection between said hulls, deck means secured to said hulls, and further at least some of said inclined mast elements are each provided over at least a portion of their length with a fin rigidly connected to a respective mast element, said lower and upper connecting means respectively of the lower end and the upper end of said inclined mast element provided with said fin allowing the rotation of each of said inclined mast elements around the longitudinal axis thereof, said fin working as a sail.

2. The catamaran-type sail boat of claim 1, further comprising substantially horizontal reinforcing cross-members having two ends interconnecting in pairs a mast-like element connected to one hull with an opposite mast-like element connected to the other hull, each end of the cross-member being provided with collar means in which said respective mast passes through and can rotate freely.

3. The catamaran-type sail boat of claim 2 comprising a slot provided in said fin in the pathway of said collar.

4. The catamaran-type said boat of claim 20, further comprising shroud fixing means cooperating with said cross-members for fixing shrouds through said cross-members.

5. A catamaran-type sail boat according to claim 1, wherein said deck means between said hulls comprise telescopic tubes.

6. A catamaran-type sail boat according to claim 1, comprising mast angular positioning means for adjusting individually and independently the angular position of each of said mast-like elements and thereby the individual angular position of each fin.

7. The catamaran-type sail boat of claim 6, wherein said mast angular positioning means comprise a first pulley rigidly connected to the lower end of the respective mast-like element and pivoting around the longitudinal axis of said respective mast, on which pulley a control cable is wound a complete turn and to which it is fixed, and a system of guide pulleys for directing both portions of said cable in a direction substantially parallel to the longitudinal axis of the sail boat towards a respective drum rotatable around an axis substantially perpendicular to the longitudinal axis of the sail boat and actuated by means of a fly-wheel.

8. The catamaran-type sail boat of claim 1, comprising at least one pivoting triangular sail suspended to said upper connecting means of said inclined mast-like elements, said pivoting said comprising a boom connected to a boom support with an axis pin at a point of connection which is located substantially at one fifth of its length from the front end of said boom.

9. The catamaran-type sail boat of claim 8, further comprising a stay on which said triangular sail is fixed, and further a sail tensioning device for tensioning said sail.

10. The catamaran-type sail boat of claim 9, wherein said sail tensioning device is constituted by a tackle pulling on said stay.

11. The catamaran-type sail boat of claim 9, wherein said tensioning device is constituted by a tackle controlling a cable pulling upwardly on a semi-circular rolling path.

12. The catamaran-type sail boat of claim 1, wherein each hull is equipped with a rubder both controlled together by means of a single bar, further comprising an angular position adjusting device for adjusting the relative angular position of one rudder with respect to the other.

13. The catamaran-type sail boat of claim 12, wherein each rudder is connected to the bar by a system of pulleys and a cable, one end of said cable being connected to said bar and the other end being connected to a slide provided with a roller displaceable in an oblong opening provided in a frame rigidly connected to said bar and whose longitudinal axis is substantially parallel to the longitudinal axis of said bar, and further an adjustable stop allows limiting in a predetermined manner the displacement of a roller in one direction, in said opening.

14. The catamaran-type sail boat of claim 1, wherein said fin is made of a single piece.

15. The catamaran-type sail boat of claim 14, wherein said fin is provided with at least one cross-member extending in a substanially perpendicular relationship to said fin and with which are associated shaped shrouds for ensuring the rigidity of the fin in the direction of the thickness thereof.

16. The catamaran-type sail boat of claim 15, wherein each cross-member is removable from said fin.

17. The catamaran-type sail boat of claim 15, wherein said shaped shrouds are substantially of a lozenge shape.

18. A catamaran-type sail boat comprising two separate hulls, connecting means between said hulls comprising four inclined mast-like elements, each having an upper end and a lower end, lower connecting means between the lower end of each inclined mast-like element and the respective hull, upper connecting means for connecting together the upper ends of said four mast-like elements at a common point, providing thereby a rigid-type connection between said hulls, deck means secured to said hulls, and further at least some of said inclined mast elements are each provided over at least a portion of their length with a fin rigidly connected to a respective mast element, said lower and upper connecting means respectively of the lower end and the upper end of said inclined mast element provided with said fin allowing rotation of each of the said inclined mast elements around the longitudinal axis thereof, said fin working as a sail.

19. A catamaran-type said boat according to claim 18, wherein said four mast-like elements are connected together at a common point by a connecting pyramidal structure comprising a front triangle and a rear triangle, said triangles being defined by tubes rigidly connected to one another at one end thereof and having the opposite end accommodated pivotally in the upper ends of the respective masts.

20. A catamaran-type sail boat comprising at least two separate hulls, connecting means between said hulls comprising at least a group of four inclined mast-like elements, each having an upper end and a lower end, lower connecting means between the lower end of each inclined mast-like element and a respective hull, upper connecting means for connecting together the upper ends of said group of four mast-like elements at a common point providing thereby a rigid-type connection between said hulls, deck means secured to said hulls, and further at least some of said inclined mast-like elements are each provided over at least a portion of their length with a fin rigidly connected to a respective mast-like element, said lower and upper connecting means respectively of the lower end and upper end of said inclined mast-like element provided with said fin allowing rotation of each of said inclined mast elements around the longitudinal axis thereof, said fin working as a sail, said upper connecting means comprising a rigid pyramidal structure comprising a front triangle and a rear triangle, each of said front and rear triangles being defined by two tube members having two ends, one end of the tube members of the same triangle being rigidly connected to a common linking plate whereas the other opposite free end is pivotally accommodated in the upper end of a respective mast-like element, said front and rear triangles being pivotally connected respective to one another at said common point.

21. The catamaran-type sail boat of claim 20, wherein said common linking plate is interposed between said tube members of the same triangle, the common linking plate between the tube members of the front triangle being mounted in rotation around a rotation axle between two distinct common linking plates interposed between the two tube members defining said rear triangle, said two distinct common linking plates of said rear triangle having interposed between them an intermediary plate allowing pivoting of the common linking plate of the front triangle.

* * * * *